US010886096B2

(12) United States Patent
Moeller et al.

(10) Patent No.: US 10,886,096 B2
(45) Date of Patent: Jan. 5, 2021

(54) TARGET FOR GENERATING X-RAY RADIATION, X-RAY EMITTER AND METHOD FOR GENERATING X-RAY RADIATION

(71) Applicant: Siemens Healthcare GmbH, Erlangen (DE)

(72) Inventors: Marvin Moeller, Jena (DE); Sven Mueller, Urbich (DE); Martin Koschmieder, Uhlstaedt-Kirchhasel (DE); Stefan Willing, Rudolstadt (DE); Benno Cyliax, Remda-Teichel (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 0 days.

(21) Appl. No.: 16/519,245

(22) Filed: Jul. 23, 2019

(65) Prior Publication Data

US 2020/0035439 A1 Jan. 30, 2020

(30) Foreign Application Priority Data

Jul. 25, 2018 (EP) ..... 18185506

(51) Int. Cl.
*H01J 35/00* (2006.01)
*H01J 35/08* (2006.01)

(52) U.S. Cl.
CPC ..... *H01J 35/116* (2019.05)

(58) Field of Classification Search
CPC .... H01J 35/116; H01J 2235/088; H01J 35/08; H01J 35/04; H01J 2235/081; G21K 5/00
See application file for complete search history.

(56) References Cited

U.S. PATENT DOCUMENTS 3,999,096 A 12/1976 Funk et al.
4,323,780 A 4/1982 Tombaugh et al.
7,203,283 B1 * 4/2007 Puusaari ..... H01J 35/08 378/143

(Continued)

FOREIGN PATENT DOCUMENTS

DE 2533348 A1 6/1976
EP 0022948 A1 1/1981
GB 762375 A 11/1956

OTHER PUBLICATIONS

Wikipedia: "Messingwerk"; Anonymous, Jun. 6, 2012; XP055558057; gefunden im Internet: URL:https://de.wikipedia.org/wiki/Messingwerk; 2012.

(Continued)

*Primary Examiner* — Kiho Kim
(74) *Attorney, Agent, or Firm* — Harness, Dickey & Pierce, P.L.C.

(57) ABSTRACT

A target is for generating X-ray radiation by way of loading with a particle stream containing charged particles. In an embodiment, the target includes a layer structure including at least two metallic layers. A target surface, loadable by the particle stream, is formed by a first layer of the at least two metallic layers of the layer structure including a material including a first metallic element. A second layer of the at least two metallic layers of the layer structure includes a material including a second metallic element. Finally, an ordinal number of the first metallic element is less than an ordinal number of the second metallic element.

28 Claims, 6 Drawing Sheets

(56) References Cited

U.S. PATENT DOCUMENTS

| | | | | |
|---|---|---|---|---|
| 2009/0041197 | A1 | 2/2009 | Clayton | |
| 2010/0040202 | A1* | 2/2010 | Lee | H01J 35/16 378/143 |
| 2010/0201240 | A1 | 8/2010 | Heinke et al. | |
| 2011/0051899 | A1 | 3/2011 | Schumacher et al. | |
| 2011/0142202 | A1 | 6/2011 | Brown et al. | |
| 2012/0280640 | A1* | 11/2012 | Moller | H05H 7/08 315/505 |
| 2013/0287177 | A1* | 10/2013 | Funk | A61B 6/4035 378/141 |
| 2014/0037055 | A1* | 2/2014 | Ogura | H01J 35/08 378/51 |
| 2014/0086388 | A1* | 3/2014 | Yamada | H01J 35/08 378/62 |
| 2014/0126701 | A1* | 5/2014 | Ogura | H01J 35/16 378/121 |
| 2014/0362973 | A1* | 12/2014 | Ogura | G01N 23/04 378/62 |
| 2016/0336140 | A1 | 11/2016 | Nonoguchi et al. | |
| 2016/0345418 | A1 | 11/2016 | Whittum et al. | |

OTHER PUBLICATIONS

European Search Report for European Patent Application No. 18185506 dated Feb. 19, 2019.

* cited by examiner

TARGET FOR GENERATING X-RAY RADIATION, X-RAY EMITTER AND METHOD FOR GENERATING X-RAY RADIATION

PRIORITY STATEMENT

The present application hereby claims priority under 35 U.S.C. § 119 to European patent application number EP18185506.5 filed Jul. 25, 2018, the entire contents of which are hereby incorporated herein by reference.

FIELD

At least one embodiment of the invention generally relate to a target for generating X-ray radiation by way of loading with a particle stream containing charged particles, in particular electrons.

At least one embodiment of the invention further relates to an X-ray emitter having a particle source emitting a particle stream and an acceleration device, in particular an acceleration device comprising a plurality of cavity resonators coupled to each other, which is designed to generate a particle stream directed onto the target.

At least one embodiment of the invention further relates to a method for generating X-ray radiation by way of loading the target with a particle stream containing charged particles, in particular electrons.

BACKGROUND

It is known to use X-ray emitters, in particular high-energy X-ray emitters, to provide X-ray radiation in the MeV range, in medical and non-medical applications. X-ray radiation or braking radiation is generated in a known manner in that a target is loaded with a particle stream of accelerated and charged particles, usually electrons. The particles are decelerated, so that they emit part of their kinetic energy as photon or X-ray radiation. Linear accelerators are used in particular to accelerate the charged particles or electrons.

A medical field of application for X-ray radiation generated in this way relates to radiotherapy. Another technical field of application relates to non-destructive material testing or the screening of objects, in particular in the context of an imaging safety check or in the context of an imaging inspection of cargo. In the latter case, for example for the screening of large objects, such as cargo containers for example, screening systems are known in which linear accelerators are used for the generation of photons in the MeV range. The X-ray radiation attenuated during penetration of the object is detected in a spatially resolved manner by an X-ray detector.

For reasons of radiation protection, many applications require the reduction as far as possible of X-ray radiation emitted outside the effective radiation field, in particular scattered and leakage radiation. The X-ray radiation outside the effective radiation field is typically reduced by shielding and collimation screens, which contribute significantly to the total weight of the system, in particular the linear accelerator.

SUMMARY

Embodiments of the invention disclose a device and a method for generating X-ray radiation in such a way that the proportion of generated X-ray radiation outside the desired effective radiation field is reduced.

Embodiments of the invention are directed to a target for generating X-ray radiation, a linear accelerator and a method for generating X-ray radiation.

Advantageous developments of the invention are the subject matter of the claims.

At least one embodiment is directed to a target (also: scattered body) for generating X-ray radiation by way of loading with a particle stream containing charged particles, in particular electrons, according to the invention has a layer structure comprising at least two metallic layers. A target surface, which can be loaded by the particle stream, is formed by a first layer of the layer structure, which includes a material comprising a first metallic element. A second layer of the layer structure includes a material comprising a second metallic element. The ordinal number of the first metallic element is less than the ordinal number of the second metallic element.

At least one embodiment is directed to X-ray emitter having a particle source emitting a particle stream and an acceleration device, in particular an acceleration device of a linear accelerator, comprising a plurality of cavity resonators that are coupled to each other, is designed to generate a particle stream directed onto a target, in particular onto at least one embodiment of the above-mentioned target.

According to at least one embodiment of the invention, the target has a layer structure comprising at least two metallic layers, wherein the target surface, which can be loaded by the particle stream, is formed by the first layer of the layer structure, which includes the material comprising the first metallic element. The second layer of the layer structure is formed from the material comprising the second metallic element, wherein the ordinal number of the first metallic element is less than the ordinal number of the second metallic element.

In an embodiment, a method for generating X-ray radiation by way of loading a target, in particular the previously described target, with a particle stream containing charged particles, in particular electrons, is characterized in that the target has a layer structure comprising at least two metallic layers. The target surface loaded by the particle stream is formed by the first layer of the layer structure. The first layer includes the material comprising the first metallic element and the second layer of the layer structure includes the material comprising the second metallic element. The ordinal number of the first metallic element is less than the ordinal number of the second metallic element.

According to at least one embodiment of the invention, a target is for generating X-ray radiation by way of loading with a particle stream containing charged particles. The target includes a layer structure comprising

- at least two metallic layers, a target surface, loadable by the particle stream, being formed by a first layer of the at least two metallic layers of the layer structure including a material comprising a first metallic element, wherein a second layer of the at least two metallic layers of the layer structure includes a material comprising a second metallic element, and wherein an ordinal number of the first metallic element is less than an ordinal number of the second metallic element.

According to at least one embodiment of the invention, an X-ray emitter, comprises:

- a particle source to emit a particle stream; and
- an acceleration device including a plurality of cavity resonators coupled to each other, to generate a particle stream directed onto a target, the target including a layer structure comprising at least two metallic layers, wherein a target surface, loadable by the particle stream, is formed by a first layer of the at least two metallic layers of the layer structure, including a material comprising a first metallic element, wherein a second layer of the at least two metallic layers of the layer structure includes a material comprising a second metallic element, wherein an ordinal number of the first metallic element is less than an ordinal number of the second metallic element.

According to at least one embodiment of the invention, a method of generating X-ray radiation, comprising:

loading a target with a particle stream containing charged particles to generate the X-ray radiation, the target including a layer structure comprising at least two metallic layers, wherein a target surface loaded by the particle stream is formed by a first layer of the at least two metallic layers of the layer structure includes a material comprising a first metallic element, and wherein a second layer of the at least two metallic layers of the layer structure includes a material comprising a second metallic element, wherein an ordinal number of the first metallic element is less than an ordinal number of the second metallic element.

BRIEF DESCRIPTION OF THE DRAWINGS

For a further description of the invention reference will be made to the example embodiment shown in the drawing figures. In the drawings, in a schematic representation.

Mutually corresponding parts are provided with the same reference numerals in all figures.

DETAILED DESCRIPTION OF THE EXAMPLE EMBODIMENTS

Figure 1:
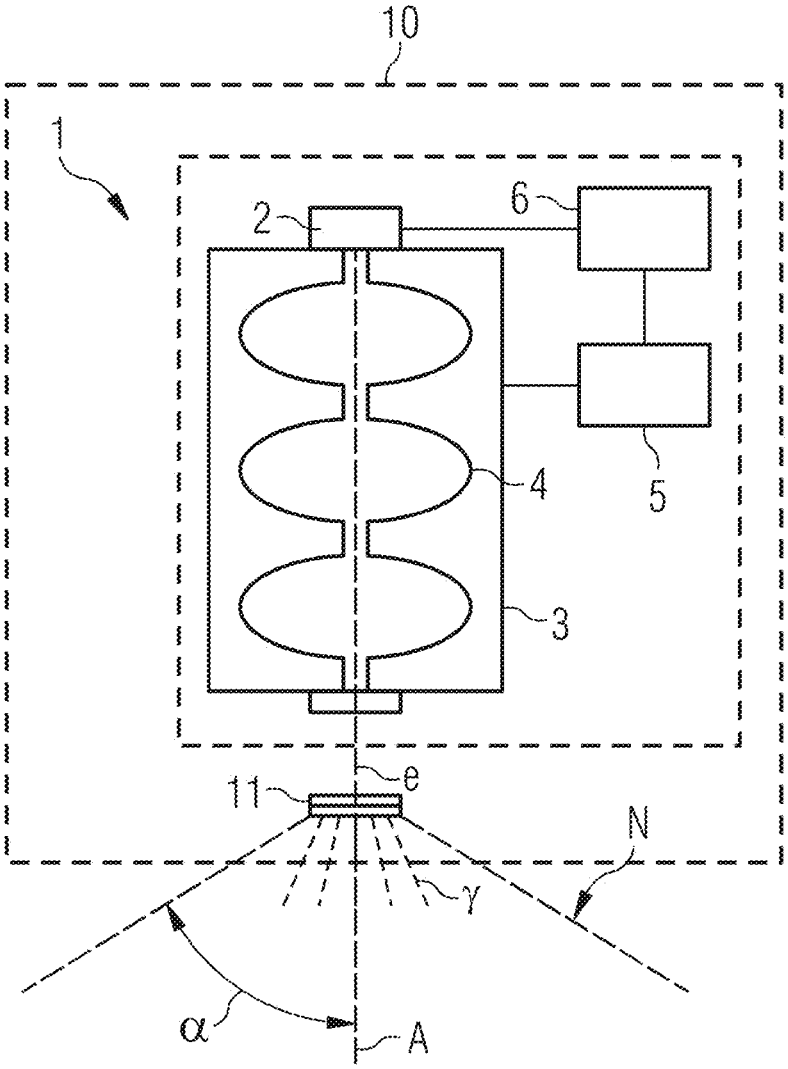
FIG. 1: shows the schematic structure of an X-ray emitter with a linear accelerator.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuitry such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

At least one embodiment is directed to a target (also: scattered body) for generating X-ray radiation by way of loading with a particle stream containing charged particles, in particular electrons, according to the invention has a layer structure comprising at least two metallic layers. A target surface, which can be loaded by the particle stream, is formed by a first layer of the layer structure, which includes a material comprising a first metallic element. A second layer of the layer structure includes a material comprising a second metallic element. The ordinal number of the first metallic element is less than the ordinal number of the second metallic element.

At least one embodiment of the invention is based on the finding that the interaction of the accelerated particles, in particular electrons, with the atoms in the material of the target at given acceleration of the particles, at given acceleration voltage therefore, significantly influences the emission of photons or X-ray quanta inside and outside the effective radiation field. In particular, the interaction between the particle stream and the material of the target determines the proportion and energy of the back-scattered particles. It has now been found that these back-scattered particles (also: secondary electrons) are responsible for a significant proportion of leakage and scattered radiation outside the effective radiation field since these are decelerated elsewhere in one of the surrounding materials and thus contribute to the emission of electromagnetic radiation, in particular X-ray radiation.

At least one embodiment of the invention is directed to reducing the energy of the back-scattered particles by a purposeful arrangement of different materials in the target. As a result, a significant reduction in mass can then occur by reducing the shielding in particular contrary to the beam direction of the incoming particle stream.

The target according to at least one embodiment of the invention is designed in such a way that with a comparable effective radiation field, the proportion of the back-scattered particles or electrodes is reduced compared to the known approach. For this purpose, the interaction of the accelerated particles with the different materials is exploited. For metallic elements with a high ordinal number (also: atomic number, proton number), this interaction is generally stronger than with metallic elements with a lower ordinal number. Therefore, both the deflection of the particles as a function of the penetration depth as well as the yield of generated X-ray radiation is different. In order to ensure a maximum yield of X-ray radiation, in particular braking radiation, the target should be designed in such a way that the target surface loaded or loadable with the particle stream includes a material comprising elements with an optimally high atomic number.

The design of the target is characterized in that a material with a smaller ordinal number is positioned upstream from the point of view of the incoming particle stream. In other words, the loadable target surface is formed by the first layer whose material has metallic elements with a smaller ordinal number. The second layer, in particular immediately adjacent to the first layer, comprises correspondingly metallic elements with a higher ordinal number. With such a structural design of the target, the yield of X-ray radiation per incoming particle is somewhat reduced, but the proportion of backscattered particles, in particular electrons, is significantly reduced. The shielding provided for attenuation of X-ray radiation outside the intended effective radiation field can be significantly reduced, in particular by more than a half-value layer thickness in applications. Since the shielding of most X-ray emitters for the generation of high-energy X-ray radiation accounts for the largest share of the total weight, the weight advantage is significant for the overall system.

The layer structure of the target comprises at least two layers. In an embodiment, the target is formed by a layer structure having exactly two layers.

In an embodiment, the ordinal number of the first metallic element is less than 36 and the ordinal number of the second metallic element more than 36. The first metallic element is, for example, a metal of the third or fourth period, such as copper (Cu). The second metallic element is, for example, a metal of the fifth or sixth period, such as tungsten (W).

In an embodiment, the difference between the ordinal number of the second metallic element and the ordinal number of the first metallic element is at least 18.

In an embodiment, the first and second material is a metal or a metal alloy. In the case where the first and/or second material is a homogeneous metal, this can be formed in particular by the first and/or second metallic element. If the first and/or second material is a metal alloy, the first and/or second metallic element is correspondingly part of the metal alloy.

In an embodiment, the first metallic element is copper and the second metallic element is tungsten. The first layer can consist in particular of a copper-containing metal alloy. The second layer can consist in particular of a tungsten-containing metal alloy. Alternatively, the first layer can consist essentially of elementary copper and the first layer essentially of elemental tungsten. The term "essentially" should be taken to mean that impurities due to foreign metals and/or oxidation are also included.

In an embodiment, a layer thickness of the first layer lies in the region between 0.3 to 0.7 times the range of electrons in the material from which the first layer is formed. A layer thickness of the second layer is correspondingly also preferably in the region between 0.3 to 0.7 times the range of electrons in the material from which the second layer is formed. The layer thickness of the first layer is therefore chosen in particular as a function of the mean particle energy of the particle stream loading the target such that at least a significant proportion of the incoming particles penetrates the first layer. In other words, the mean penetration depth of the incoming particles is greater than the layer thickness of the first layer. The mean particle energy is in particular in the range of MeV.

It is understood that the transition from the at least one first layer to the at least one second layer does not necessarily have to be abrupt, but rather, in an embodiment, it can be provided that the material composition of the target continuously changes from the first to the second layer. Generative manufacturing processes, such as sintering, selective laser melting or 3D printing are particularly suitable for the production of such targets with varying material composition.

At least one embodiment is directed to X-ray emitter having a particle source emitting a particle stream and an acceleration device, in particular an acceleration device of a linear accelerator, comprising a plurality of cavity resonators that are coupled to each other, is designed to generate a particle stream directed onto a target, in particular onto at least one embodiment of the above-mentioned target.

According to at least one embodiment of the invention, the target has a layer structure comprising at least two metallic layers, wherein the target surface, which can be loaded by the particle stream, is formed by the first layer of the layer structure, which includes the material comprising the first metallic element. The second layer of the layer structure is formed from the material comprising the second metallic element, wherein the ordinal number of the first metallic element is less than the ordinal number of the second metallic element.

The advantages of an X-ray emitter with a target designed and aligned in this way are directly derived from the previous description. Since the loaded target surface is formed by the first layer, comprising constituents with a low ordinal number, the proportion in particular of back-scattered particles or electrons is reduced. This reduces scattered and leakage radiation caused by these back-scattered particles. The shielding in particular in the reverse direction to the incoming particle stream can therefore be reduced. This leads to a significant reduction in weight since the total weight of the system is largely determined by the dimensioning of the shielding.

In an embodiment, the particle stream loading the target surface is aligned along a beam axis, which runs essentially perpendicularly to the at least two layers of the layer structure. The first and second layers are in particular directly adjacent to each other and run, for example, parallel to each other.

In an embodiment, the acceleration device is designed to accelerate the particles in the particle stream to a mean particle energy in the range of MeV, in particular in the range of more than 1 MeV and less than 20 MeV. The target is loaded in particular in such a way that the X-ray or braking radiation is radiated to a large extent in the direction of the incoming particle stream, after at least sectional penetration of the target therefore. In this sense, the target can also be called a transmission target. In particular, the mean particle energy should be chosen as a function of the layer thicknesses of at least one first and second layer accordingly.

In an embodiment, the target for the radiation of X-ray radiation is arranged in a solid angle range of less than 60° around the beam axis, preferably of about 35° around the beam axis, arranged in particular in the direction, in the intended extension of the particle stream loading the target surface therefore. In other words, the effective radiation field and the incoming particle stream are arranged on opposite sides of the target.

In an embodiment, a method for generating X-ray radiation by way of loading a target, in particular the previously described target, with a particle stream containing charged particles, in particular electrons, is characterized in that the target has a layer structure comprising at least two metallic layers. The target surface loaded by the particle stream is formed by the first layer of the layer structure. The first layer includes the material comprising the first metallic element and the second layer of the layer structure includes the material comprising the second metallic element. The ordinal number of the first metallic element is less than the ordinal number of the second metallic element.

Advantages of at least one embodiment of the method using a target designed and aligned in such a way results directly from the previous description with reference to the corresponding device. Loading of a target surface, which is formed by the first layer comprising constituents with a low ordinal number, results in a changed yield of X-ray radiation per incoming particle. In particular, the proportion of X-ray radiation emitted in the direction of the beam axis, in the forward direction of the particle stream therefore, is changed in relation to the particles scattered in the reverse direction. With a given yield of X-ray radiation in the forward direction, the proportion of particles or electrons scattered in the reverse direction, in particular compared to known methods, can be reduced.

In an embodiment, the particle stream loading the target surface is aligned along a beam axis, which runs essentially perpendicularly to the at least two layers of the layer structure. The second layer can in particular form a side of the target facing away from the particle stream.

In an embodiment, the target for radiation of X-ray radiation is arranged in a solid angle range of less than 60° around the beam axis, preferably of about 35° around the beam axis, in particular in the direction of the particle stream loading the target surface. In other words, the effective radiation field and the incoming particle stream are arranged on opposite sides of the target.

In an embodiment, the particles in the particle stream are accelerated with the aid of an acceleration device, in particular with the aid of an acceleration device of a linear accelerator, comprising a plurality of coupled cavity resonators, to a mean particle energy in the range of MeV, in particular in the range of more than 1 MeV and less than 20 MeV. In other words, preferably a particle stream is generated, with which braking or X-ray radiation can be generated in a spectral range, which is suitable for screening solid containers, such as in particular the goods containers, freight containers or railway wagons common in the movement of goods.

In an embodiment, the generated X-ray radiation, in particular braking radiation, is provided for non-destructive material testing, for the imaging inspection of cargo and/or for medical radiotherapy.

FIG. 1 shows the principal structure of an X-ray emitter 10 having a target 11, which is loaded by a particularly pulsed particle stream of charged particles e to generate X-ray or braking radiation γ. The pulse or pulsed particle stream e of charged particles—in the present case these are electrons—can be generated by means of the linear accelerator 1, which comprises a particle source 2, for example an electron cannon, and an acceleration device 3, for example an accelerator tube with a plurality of coupled cavity resonators 4, in particular for the generation of electromagnetic traveling waves. An energy supply 5 supplies the acceleration device 3 with a high-frequency power to generate a high-frequency alternating field within the coupled cavity resonators 4 for the acceleration of the particle stream, which is shot or injected from the particle source 2 into the acceleration device at specified times.

The high-frequency power can be supplied in particular periodically, in other words in the form of high-frequency pulses supplied by the acceleration device 3. A controller or control device 6 is connected to both the particle source 2 and the energy supply 5 and is designed to couple or "shoot" the particle stream into the acceleration device 3 in a manner synchronized over time in respect of the periodically supplied high-frequency power.

Devices for beam shaping are not explicitly shown in FIG. 1. It is understood that a deflection magnet can be arranged in particular between the acceleration device 3 and the target 11.

The particle stream e is directed parallel to the beam axis A onto the target 11. The effective radiation field N for the generated X-ray radiation γ is essentially limited to a conical solid angle range around the beam axis A, with the opening angle α between the conical surface enclosing the solid angle range and the beam axis A being 60° or less.

Figure 2:
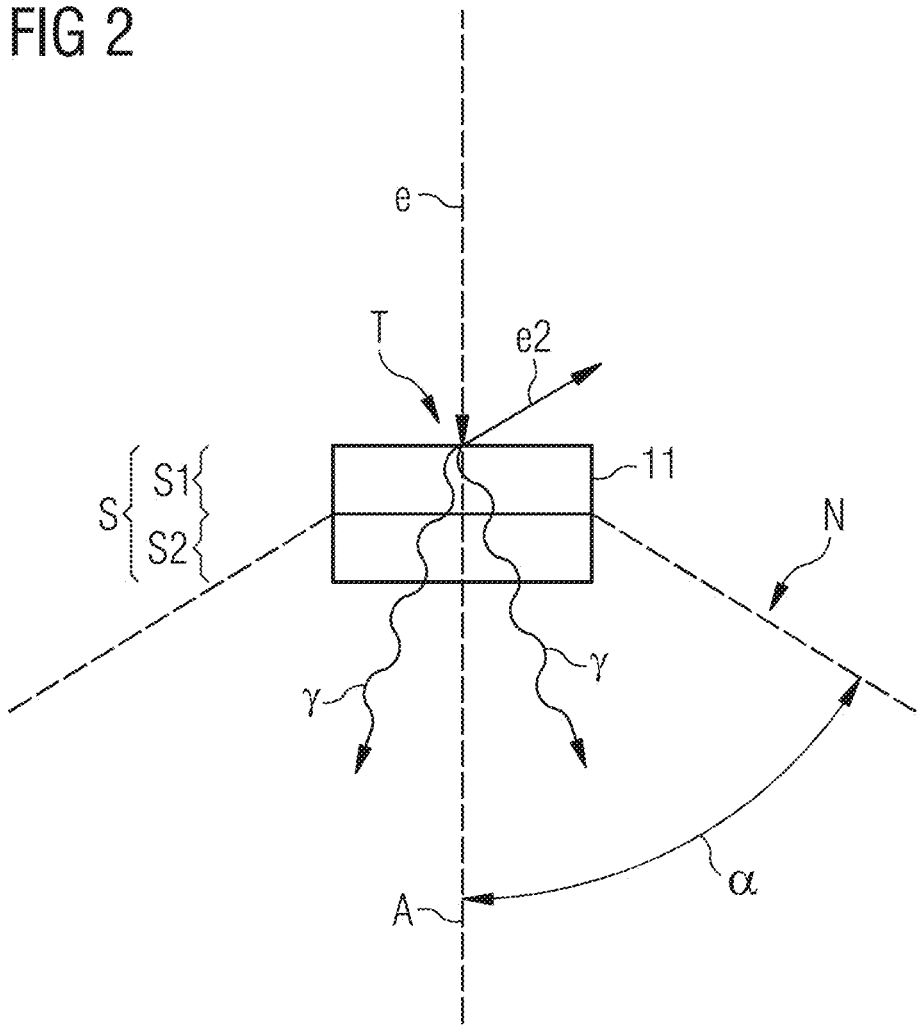
FIG. 2: shows a target, having a layer structure, for the X-ray emitter of FIG. 1.

The target 11 has a layer structure S, which is shown in detail in FIG. 2. The target 11 is formed by two essentially homogeneous layers S1, S2.

The material of the first layer S1 comprises a first metallic element of relatively low ordinal number Z. In the example shown, the first metallic element is copper (Z=29). Specifically, the first layer S1 is formed of copper in the non-limiting embodiment.

In another example embodiment, the first layer S1 is formed by a metal alloy containing copper (Cu).

The material of the second layer S2 comprises a second metallic element of relatively high ordinal number Z. In the example shown, the second metallic element is tungsten (Z=74). Specifically, the second layer S2 is formed of tungsten (W) in the non-limiting embodiment.

In another example embodiment, the second layer S2 is formed by a tungsten-containing metal alloy.

A target surface T, which is loaded by the incoming particle stream e, is formed by the first layer S1 with lighter constituents of lower ordinal number Z. The second layer S2 is aligned in the direction of the opposite exit side for X-ray radiation γ.

Compared to a design and alignment of the target in such a way that the target surface T loaded by the particle stream e is formed by a material with a relatively high ordinal number Z (for example tungsten), a changed radiation characteristic occurs. First of all, it should be noted that the proportion of back-scattered particles, the proportion of secondary electrons e2 scattered contrary to the incoming direction therefore, is reduced. The changed radiation characteristic is illustrated in the graphs of FIGS. 3 to 6 using simulation results.

The design of the target 11 according to the illustrated example embodiment is therefore characterized in that from the point of view of the incoming particle or electron beam, the first layer S1 made from a material with a smaller ordinal number Z is positioned upstream of the second layer S2 made from a material with the higher ordinal number Z. This initially slightly reduces the yield of X-ray braking radiation per particle or electron, but the proportion of back-scattered particles or secondary electrons e2 is minimized significantly more.

A target whose loaded target surface is formed by tungsten serves as a comparative example. In the graphs of FIGS. 3 to 6 the curves relating to the inventive example embodiment are solid and those of the comparative example are shown in broken lines.

Figure 3:
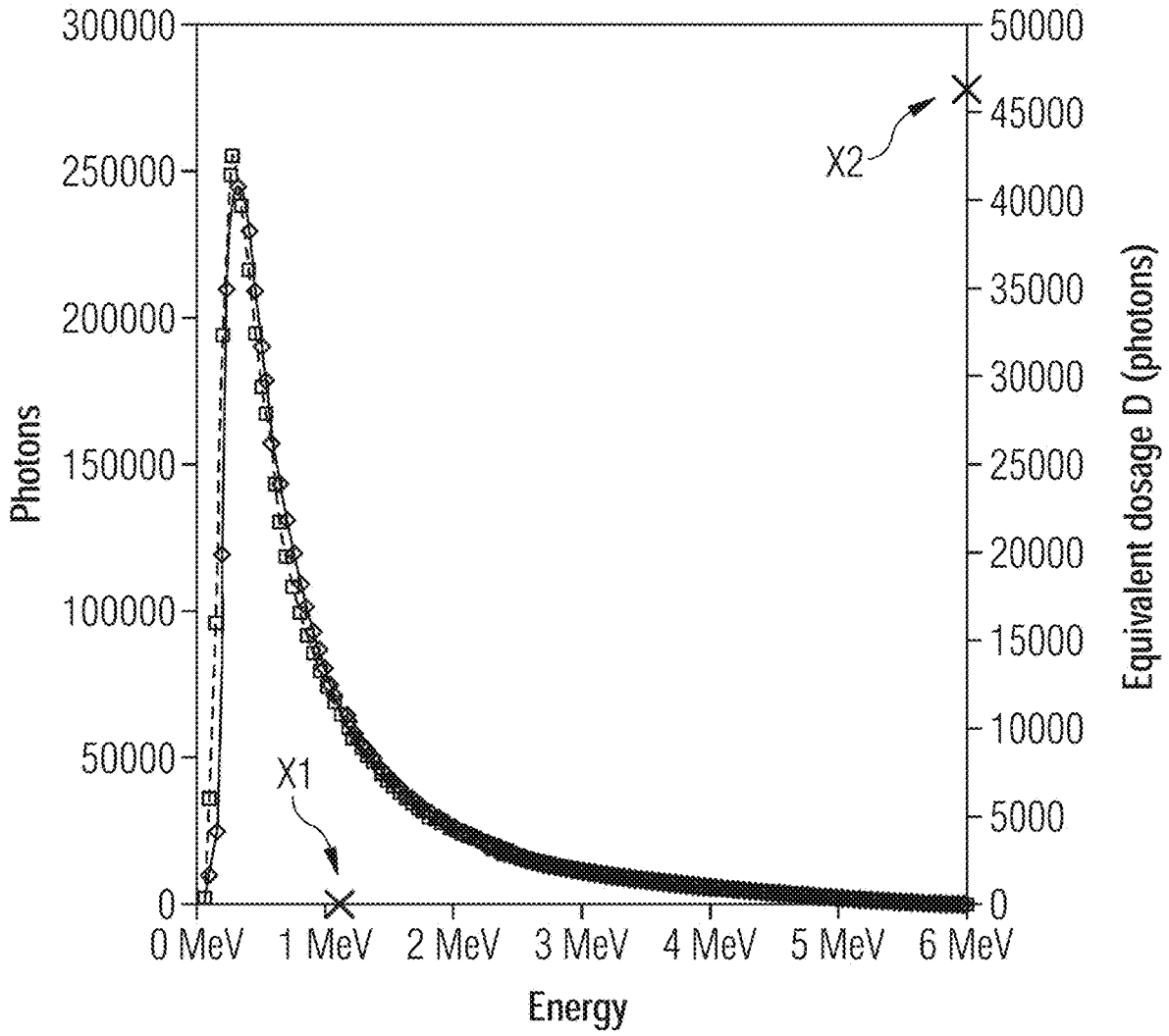
FIG. 3: shows a schematic illustration of the X-ray braking spectrum, emitted in the forward direction, of an inventive example embodiment compared to a non-inventive comparative example.

FIG. 3 illustrates the X-ray braking spectrum of the emitted X-ray radiation γ of the example embodiment and the comparative example.

On the X-axis, the energy of the emitted photons or X-ray quanta is shown in MeV. The mean energy of the emitted spectra is recorded on the X-axis as marker X1. On the left Y-axis, the number of photons of the corresponding energy is shown, while on the right Y-axis the total product of the respective spectrum is scaled as equivalent dose D with a further marker X2.

It can be seen that the simulation was aligned by adjusting the number of shot-in particles, so that in the beam direction in each case, in a solid angle range therefore, which is defined by an opening angle of $\alpha=+/-50°$ in respect of the beam axis A, in each case essentially the same radiation characteristic is present in respect of the number of emitted photons and emitted equivalent dose D. In particular, the emitted X-ray braking spectra of the example embodiment and the comparative example respectively correspond to each other in respect of their mean energy (X1) and equivalent dose (X2). In the variant according to the example embodiment, about 1.4 times as many accelerated particles were needed as in the variant according to the comparative example. The simulation of the example embodiment is therefore based on a particle stream e increased by 1.4 times.

Figure 4:
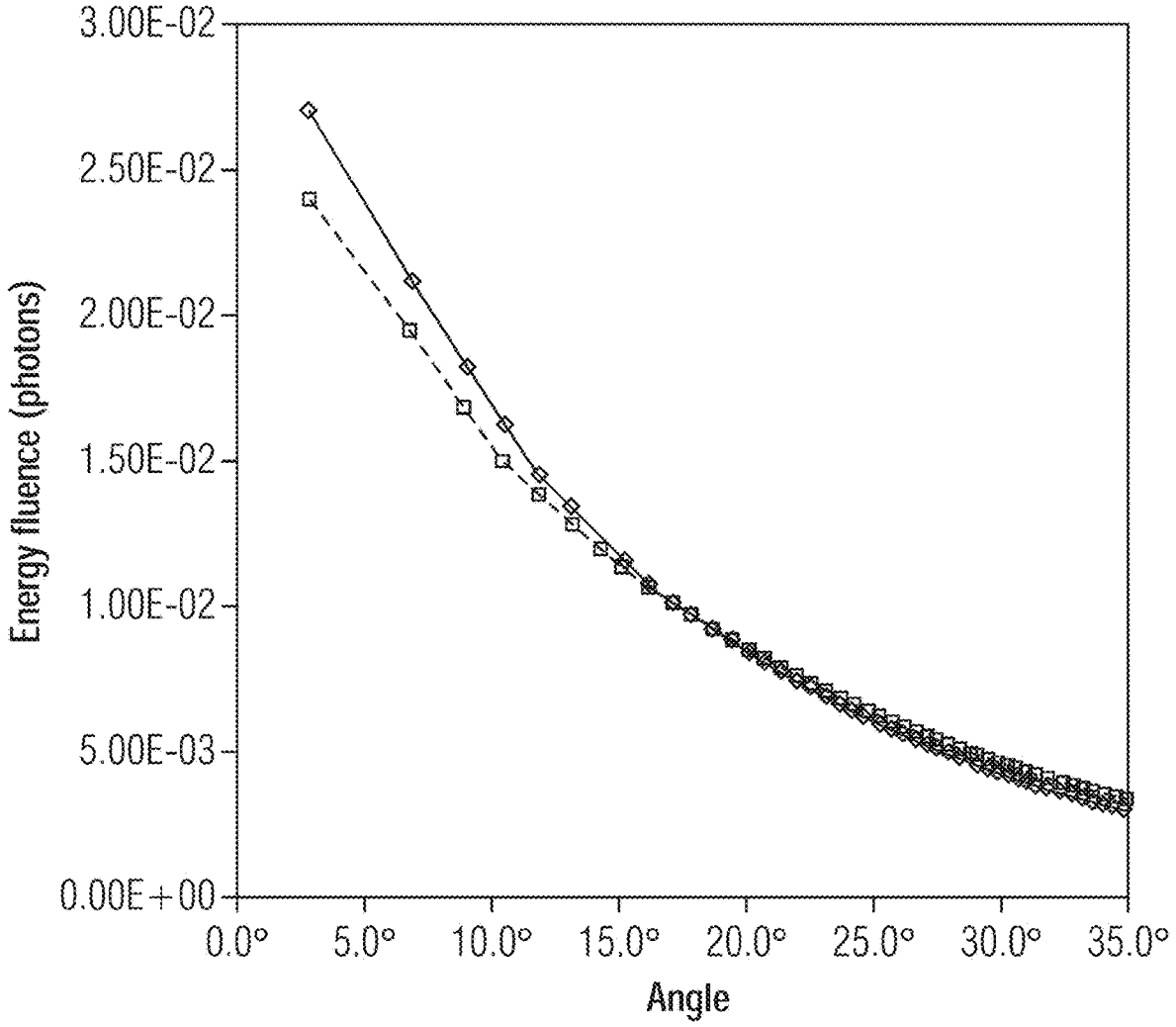
FIG. 4: shows a schematic illustration of the angular distribution of the X-ray braking spectrum, emitted in the forward direction, of the example embodiment compared to the comparative example.

FIG. 4 illustrates the energy fluence of the photons (Y-axis) as a function of the angle (X-axis) of the X-ray radiation γ emitted in the forward direction, in the direction of the incoming particle stream e therefore. An angle 0° corresponds to a trajectory parallel to the beam axis A. It can be seen that the photon distribution over the angle is slightly more forward-directed in the comparative example than in the example embodiment, in other words the emitted X-ray radiation γ is concentrated slightly more strongly on the near-axis area around the beam axis A.

Figure 5:
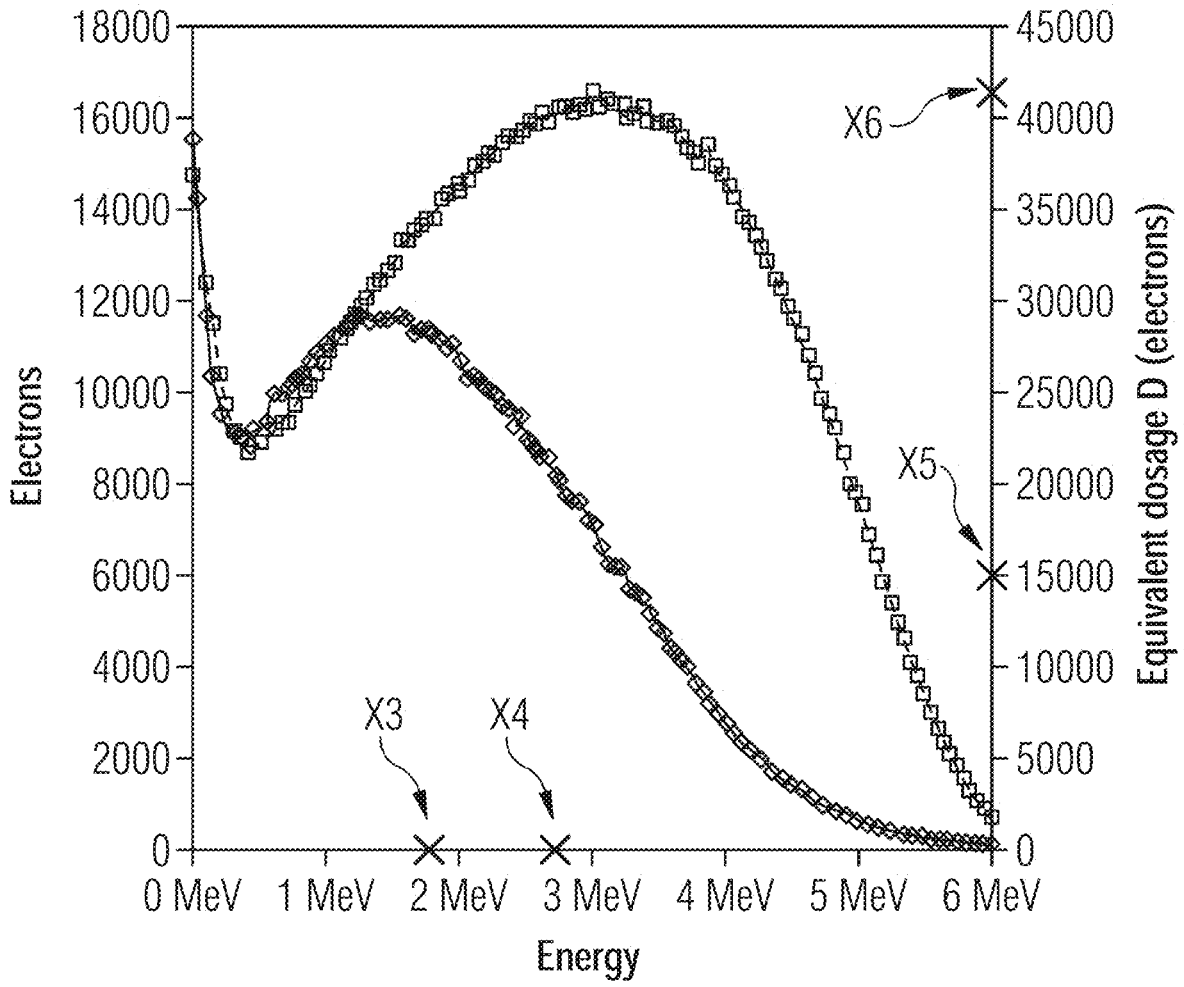
FIG. 5: shows a schematic illustration of the scattered spectrum, back-scattered in the reverse direction, of the example embodiment compared to the comparative example.
Figure 6:
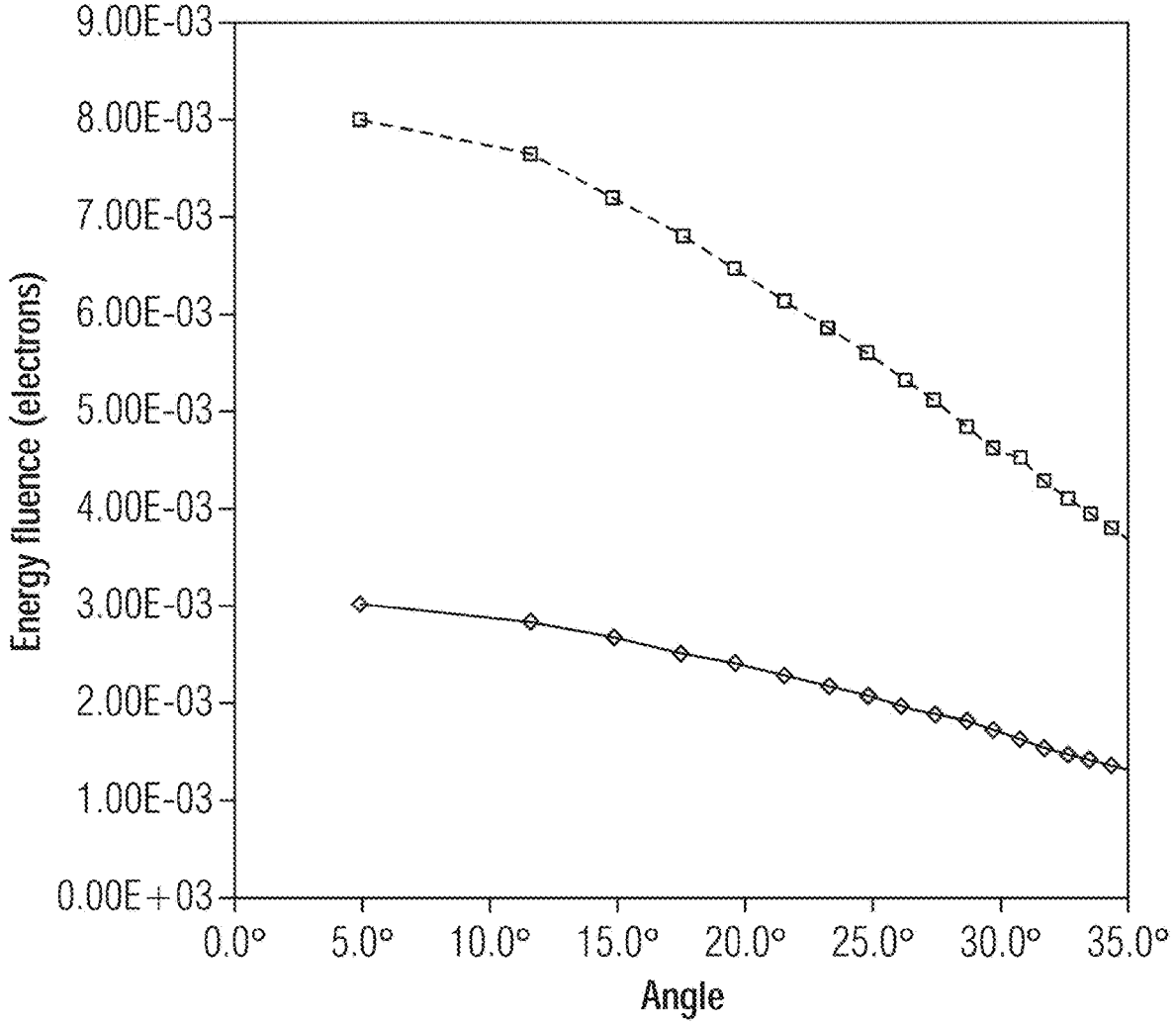
FIG. 6: shows a schematic illustration of the angular distribution of the back-scattered electrons of the example embodiment compared to the comparative example.

FIGS. 5 and 6 illustrate the characteristics of the back-scattered particles, particles charged contrary to the incoming particle stream e of scattered spectrum therefore. A representation equivalent to that in FIGS. 3 and 4 is selected, but for the particles or electrons scattered contrary to the effective radiation direction.

FIG. 5 illustrates the scattered spectrum, back-scattered in the reverse direction, of the example embodiment compared to the comparative example.

On the X-axis, the energy of the back-scattered particles or secondary electrons e2 is shown in MeV. The mean energy of the scattered spectra is recorded on the X-axis as markers X3, X4. The number of back-scattered particles (electrons) of the corresponding energy is shown on the left Y-axis, while the total product of the respective spectrum is recorded as an equivalent dose D with further markers X5, X6 on the right Y-axis.

In the variant according to the example embodiment, both the mean energy X3 and the number of back-scattered electrons or the equivalent dose X5 is significantly lower than the corresponding values X4, X6 of the comparative example. If the back-scattered particles or electrons weighted with their respective energy are compared with each other (see equivalent dose), there is a difference of about a factor of 3.

FIG. 6 shows the energy fluence distribution of the back-scattered particles or electrons over the angle. An angle 0° corresponds to a trajectory antiparallel to the beam axis A, a trajectory therefore, which is directed contrary to the incoming particle stream e. It can be seen that in the example embodiment, significantly fewer particles are back-scattered in the example embodiment than in the comparative example.

Although the invention has been illustrated and described in detail with reference to the preferred example embodiment, it is not restricted hereby. A person skilled in the art can derive other variations and combinations here from without deviating from the essential idea of the invention.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A target for generating X-ray radiation by way of loading with a particle stream containing charged particles, the target including a layer structure comprising at least two metallic layers, a target surface, loadable by the particle stream, being formed by a first layer of the at least two metallic layers of the layer structure including a material comprising a first metallic element, wherein a second layer of the at least two metallic layers of the layer structure includes a material comprising a second metallic element, and wherein an ordinal number of the first metallic element is less than an ordinal number of the second metallic element, wherein a layer thickness of the first layer is in a region between 0.3 and 0.7 times a range of electrons in a material of the first layer and a layer thickness of the second layer is in a region between 0.3 and 0.7 times a range of electrons in a material of the second layer.

2. The target of claim 1, wherein the ordinal number of the first metallic element is less than 36 and the ordinal number of the second metallic element is more than 36.

3. The target of claim 2, wherein the charged particles are electrons.

4. The target of claim 2, wherein the material comprising a first metallic element and the material comprising a second metallic element are a metal or a metal alloy.

5. The target of claim 2, wherein the first metallic element is copper and the second metallic element is tungsten.

6. The target of claim 1, wherein the material comprising a first metallic element and the material comprising a second metallic element are a metal or a metal alloy.

7. The target of claim 1, wherein the first metallic element is copper and the second metallic element is tungsten.

8. The target of claim 1, wherein the target is formed via a generative manufacturing process.

9. The target of claim 8, wherein the target is formed by sintering, selective laser melting or 3D printing.

10. The target of claim 8, wherein the first layer and the second layer include at least one first layer and at least one second layer, respectively, and wherein the target is formed via a generative manufacturing process such that a material composition of the target between the at least one first layer and the at least one second layer is continuously variable.

11. An X-ray emitter, comprising:

a particle source to emit a particle stream; and an acceleration device including a plurality of cavity resonators coupled to each other, to generate a particle stream directed onto a target, the target including a layer structure comprising at least two metallic layers, wherein a target surface, loadable by the particle stream, is formed by a first layer of the at least two metallic layers of the layer structure, including a material comprising a first metallic element, wherein a second layer of the at least two metallic layers of the layer structure includes a material comprising a second metallic element, wherein an ordinal number of the first metallic element is less than an ordinal number of the second metallic element, wherein a layer thickness of the first layer is in a region between 0.3 to 0.7 times a range of electrons in a material of the first layer and a layer thickness of the second layer is in a region between 0.3 and 0.7 times a range of electrons in a material of the second layer.

12. The X-ray emitter of claim 11, wherein the particle stream loading the target surface is aligned along a beam axis, essentially perpendicular to the at least two metallic layers of the layer structure.

13. The X-ray emitter of claim 12, wherein the acceleration device is designed to accelerate the particles in the particle stream to a mean particle energy in a range of more than 1 MeV and less than 20 MeV.

14. The X-ray emitter of claim 11, wherein the acceleration device is designed to accelerate particles in the particle stream to a mean particle energy in a range of more than 1 MeV and less than 20 MeV.

15. The X-ray emitter of claim 11, wherein the target for radiation of X-ray radiation is arranged in a solid angle range of less than 60° around a beam axis.

16. The X-ray emitter of claim 15, wherein the target for radiation of X-ray radiation is arranged in a solid angle range of about 35° around a beam axis.

17. The X-ray emitter of claim 15, wherein the target for radiation of X-ray radiation is arranged in a solid angle range of less than 60° around a beam axis in a direction of the particle stream loading the target surface.

18. The X-ray emitter of claim 11, wherein the particle stream contains charged particles and wherein the charged particles are electrons.

19. The X-ray emitter of claim 11, wherein the acceleration device is an acceleration device of a linear accelerator.

20. A method of generating X-ray radiation, comprising:

loading a target with a particle stream containing charged particles to generate the X-ray radiation, the target including a layer structure comprising at least two metallic layers, wherein a target surface loaded by the particle stream is formed by a first layer of the at least two metallic layers of the layer structure includes a material comprising a first metallic element, and wherein a second layer of the at least two metallic layers of the layer structure includes a material comprising a second metallic element, wherein an ordinal number of the first metallic element is less than an ordinal number of the second metallic element, wherein a layer thickness of the first layer is in a region between 0.3 to 0.7 times a range of electrons in a material of the first layer and a layer thickness of the second layer is in a region between 0.3 and 0.7 times a range of electrons in a material of the second layer.

21. The method of claim 20, wherein the particle stream, loading the target surface, is aligned along a beam axis essentially perpendicular to the at least two metallic layers of the layer structure.

22. The method of claim 20, wherein the target for radiation of X-ray radiation is arranged in a solid angle range of less than 60° around a beam axis.

23. The method of claim 22, wherein the target for radiation of X-ray radiation is arranged in a solid angle range of about 35° around a beam axis.

24. The method of claim 22, wherein the target for radiation of X-ray radiation is arranged in a solid angle range of less than 60° around a beam axis in a direction of the particle stream loading the target surface.

25. The method of claim 20, wherein particles in the particle stream are accelerated via an acceleration device comprising a plurality of coupled cavity resonators, to a mean particle energy in a range of MeV.

26. The method of claim 20, wherein the x-ray radiation generated is provided for non-destructive material testing, for imaging at least one of inspection of cargo and medical radiotherapy.

27. The method of claim 20, wherein particles in the particle stream are accelerated via an acceleration device comprising a plurality of coupled cavity resonators, to a mean particle energy in a range of more than 1 MeV and less than 20 MeV.

28. The method of claim 20, wherein the charged particles of the particle stream are electrons.

* * * * *